United States Patent [19]

Schwartz et al.

[11] Patent Number: 4,588,245

[45] Date of Patent: May 13, 1986

[54] SELF-LOCKING COUPLING NUT

[75] Inventors: Lawrence Schwartz, Huntington Beach; Jerry T. Steele, Fountain Valley, both of Calif.

[73] Assignee: Flight Connector Corporation, Rancho Dominguez, Calif.

[21] Appl. No.: 643,424

[22] Filed: Aug. 23, 1984

[51] Int. Cl.[4] ..... H01R 13/623

[52] U.S. Cl. ..... 339/89 R; 339/DIG. 2

[58] Field of Search ..... 339/89 R, 89 C, 89 M, 339/90 R, 90 C, DIG. 2; 285/82, 87, 88, 89, 92

[56] References Cited

U.S. PATENT DOCUMENTS

| | | | |
|---|---|---|---|
| 2,986,720 | 5/1961 | Chess | 339/89 C |
| 3,594,700 | 7/1971 | Nava et al. | 339/89 R |
| 3,644,874 | 2/1972 | Hutter | 339/89 C |
| 3,786,396 | 1/1974 | Kemmer et al. | 339/89 R |
| 4,165,910 | 8/1979 | Anderson | 339/89 M |
| 4,462,652 | 7/1984 | Werth et al. | 339/89 M |

*Primary Examiner*—John McQuade
*Attorney, Agent, or Firm*—Irving Keschner

[57] ABSTRACT

An electrical connector assembly having first and second electrical connector halves. Coupling and decoupling is accomplished by a coupling nut mounted on the first electrical connector, the coupling nut having a screw thread adapted to receive a screw thread on the second connector. The first electrical connector half includes an annular recess formed about its circumference. A belt member having a plurality of resilient protrusions formed thereon is positioned within the annular groove. A split-ring member having inner and outer circumferences is then positioned about said belt type member in a manner such that ratchet teeth formed on the inner circumference of the split ring can engage the protrusions on said belt member. In one embodiment, the outer circumference of said split-ring member has plurality of apertures formed thereon, the apertures being aligned with apertures formed in the coupling nut. Fastening members positioned through the co-lined apertures join the coupling nut to the split-ring, the split-ring being rotatable with the coupling nut. The fastening members integrally join the coupling nut to the first electrical connector via the split-ring thus preventing the coupling nut from being removed from the electrical connector due to any vibration or other type of disturbance. The serrations on the inner circumference of the split-ring interact with the protrusions to provide an anti-rotation feature such that coupling may be accomplished with less effort whereby a greater resistance is provided to decoupling.

21 Claims, 7 Drawing Figures

FIG. 1
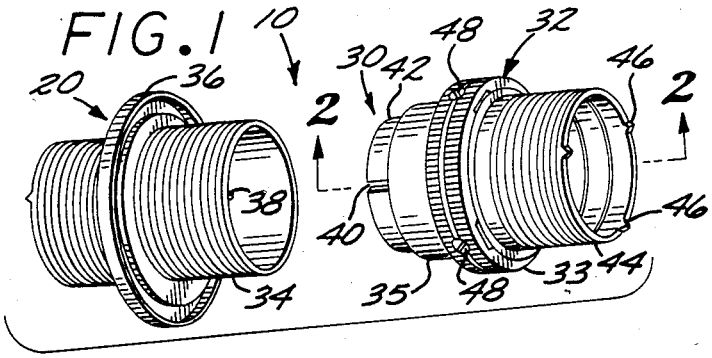
FIG. 6
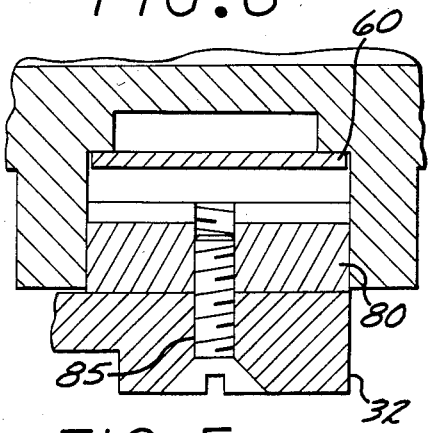
FIG. 2
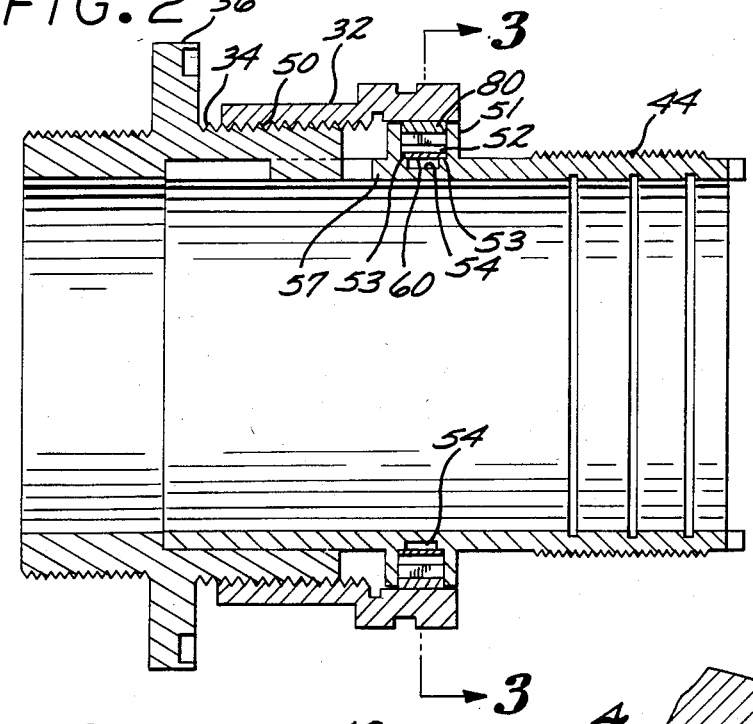
FIG. 5
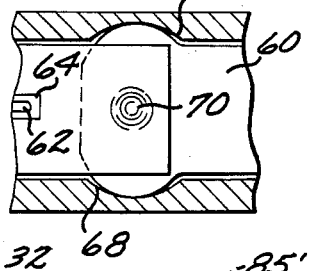
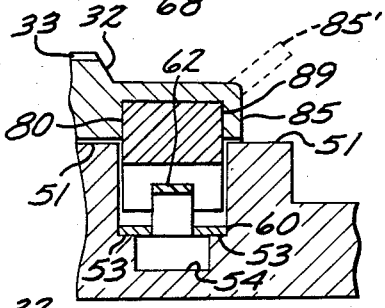
FIG. 7
FIG. 3
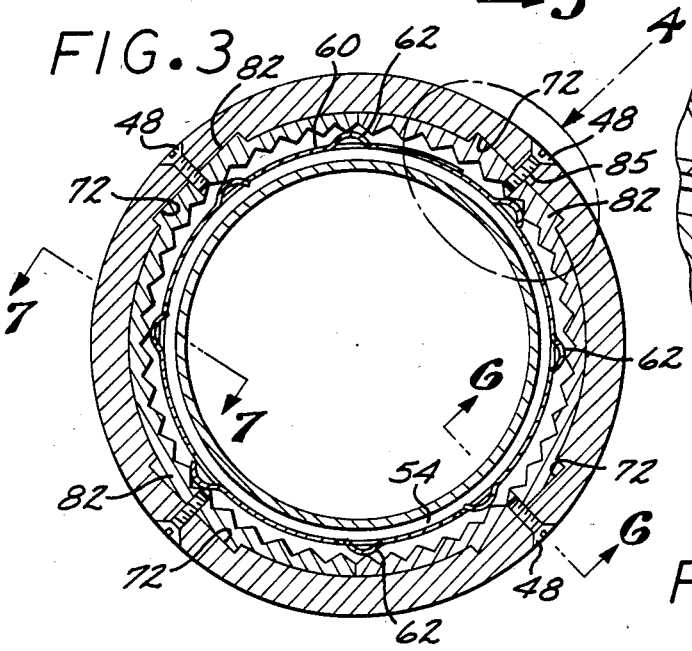
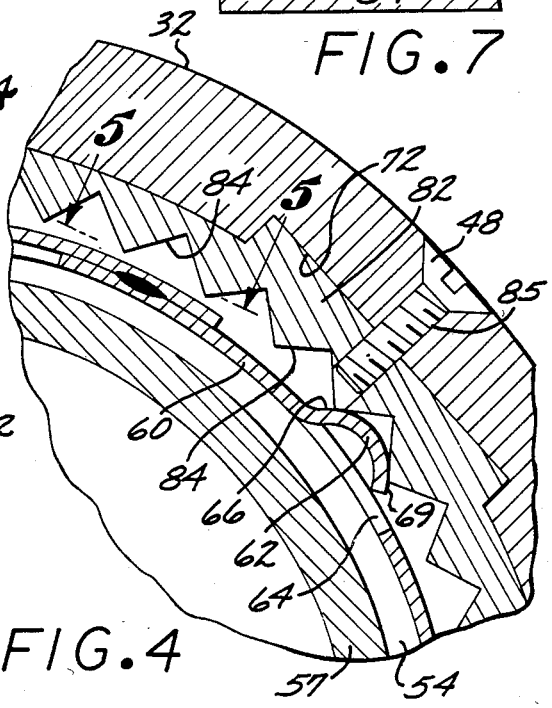
FIG. 4

SELF-LOCKING COUPLING NUT

BACKGROUND OF THE INVENTION

1. Field of the Invention

The present invention provides an improved electrical connector assembly which incorporates a coupling nut, a mechanism being provided to prevent the accidental decoupling of the connector through vibrations or other disturbances. The mechanism includes a ring member which provides two functions, the first to secure the coupling nut to the electrical connector upon which it is mounted, the second to provide an anti-rotation feature which makes for ease in coupling and a greater resistance to decoupling.

2. Description of the Prior Art

There is a constant need to provide improved electrical connectors to meet the rigid performance standards in the aerospace field. The electrical connectors should be easily and quickly coupled and decoupled with the use of reasonable forces. Hopefully, the connector assembly, once connected, should remain connected despite the vibrational or other forces which may be applied to the connector assembly which otherwise may tend to uncouple the connectors.

A number of patents have addressed themselves to this problem. For example, U.S. Pat. No. 4,291,933 discloses an electrical connector having a plug and receptacle and a coupling nut to secure the connection between the plug and receptacle. The non-decoupling mechanism includes a series of ratchet teeth disposed about the outer perimeter of the plug and a curved spring sector which is housed in the coupling nut and includes a fingertip bent inwardly to make contact with the ratchet teeth. Although the mechanism allows the coupling nut to move more easily in a tightening direction than a loosening direction, the mechanism has a tendency to fail after a number of coupling and decoupling operations. In addition, a retaining ring is necessary to prevent the coupling nut itself from sliding off of the receptacle.

U.S. Pat. No, 4,109,990 discloses another mechanism for maintaining the connector assembly coupled to a first housing and includes a spring mounted to a coupling nut and engaging ratchet teeth carried on an edge of the housing, the ratchet teeth being arranged in a particular manner which allows for ease in coupling and a greater resistance to decoupling. As noted with respect to U.S. Pat. No. 4,291,933, the use of the ratchet teeth and the spring arrangement disclosed is not reliable and tends to fail after a number of uses. A snap ring is provided to maintain the coupling nut on the body of one of the connector members.

U.S. Pat. No. 3,594,700 discloses an electrical connector threaded coupling nut lock, the locking mechanism comprising a series of circumferential spaced recesses for receiving aligned ones of a plurality circumferentially spaced projections resiliently mounted on the opposite one of the locking mechanism. Since a positive force is required to move the resiliently mounted projection between the recesses, positive force is also required to rotate the coupling nut in a uncoupling direction which provides a restraining force to prevent an inadvertent uncoupling when the connector is subject to vibrations. Although this patent provides a technique for preventing uncoupling of the connector parts, the mechanism disclosed for providing that feature is relatively complex and expensive to manufacture. A separate means is necessary to secure the coupling nut to one of the connector halves to prevent it from slipping off.

U.S. Pat. No. 4,165,910 is an electrical connector having a rotatable coupling ring, detent means being disposed between the coupling ring and the connector plug. The coupling ring has at least one interior axial slot, the detent means being releasably engaged with the slot when the connector is fully mated to substantially preclude inadvertent rotational movement of the coupling ring. As with the other patents set forth hereinabove, a mechanism (a snap ring in particular) is provided to retain the coupling nut on the electrical connector.

Other patents which relate to electrical connectors having mechanisms for minimizing the possibility of uncoupling of the connector parts due to vibration or other forces include U.S. Pat. Nos. 3,669,472; 3,808,580; 4,355,854.

Although the patents described hereinabove provide anti-rotation or decoupling features which provide various advantages, it would be desirable if an electrical connector assembly having an improved non-decoupling mechanism which was more reliable, less costly, and more easy to assemble than those available in the prior art would be provided. Obviously, one of the techniques for reducing costs is to minimize the number of parts required and to provide an assembly which has multiple uses.

SUMMARY OF THE PRESENT INVENTION

The present invention provides an electrical connector assembly having an improved non-decoupling mechanism and wherein the number of parts required in the assembly is reduced. In particular, the electrical connector assembly comprises a first connector member, or plug, and a second connector member or receptacle and a coupling nut to secure the connection between the plug and the receptacle. The coupling nut is mounted on the first electrical connector with the coupling nut having a thread adapted to receive a thread on the second connector. The first electrical connector includes an annular recessed groove formed about the circumference thereof. A flexible member having a plurality of spring-like protrusions formed thereon is secured around the bottom wall of the annular groove. A split-ring, having inner and outer circumferences, is positioned over the belt member such that the inner circumference of the split-ring, having plurality of serrations or ratchet teeth formed thereon, is positioned such to engage the protrusions formed on the belt member. A plurality of extensions are formed on the outer circumference of the split-ring, a portion of the inner surface of the coupling nut having a plurality of notch like members formed thereon. In one embodiment the notch like members are in an interference fitting arrangement with corresponding ones of the extensions to thereby join the coupling nut to the split-ring, the coupling nut thus being joined to the first electrical connector. In another embodiment, the outer circumference of the split-ring has a plurality of apertures formed therein and is positioned to be aligned with corresponding apertures formed through the coupling nut. A plurality of fastening members are utilized to join the coupling nut to the split-ring through the apertures such that the coupling nut is secured to the first electrical connector via the split-ring member. The protrusions and ratchet teeth are formed so that the coupling nut moves more easily in the coupling (tightening) direction than the decoupling (loosening) direction.

The split-ring member of the present invention thus is seen to perform two functions, i.e. one of joining the coupling nut securely to one of the electrical connector members and also providing a portion of the anti-rotation (non-decoupling mechanism) feature which makes it difficult to uncouple the connector members. The adaptability of the electrical connector assembly of the present invention is also significant in that there are situations where for one reason or another there is no requirement for an anti-rotation function and all that is required is to have a freely rotating coupling nut secured to one of the electrical connector members. The present invention allows this by simply not incorporating the flexible belt in the assembly, the split-ring member itself only being positioned in the annular groove, the coupling nut being joined to the connecting member it is mounted on via the split-ring. In the situation where both functions are required, the necessity of having a separate part to prevent the coupling nut from slipping off the electrical connector it is mounted to is eliminated since the split-ring provides that function. The system of the present invention is applicable to any free-turning coupling nut system, such as connector accessories including cable clamps and backshells and, in general, any coupling mechanical or electrical device wherein an assembling operation for joining two mating parts is required.

BRIEF DESCRIPTION OF THE DRAWINGS

For a better understanding of the invention as well as other objects and further features thereof, reference is made to the following description which is to be read in conjunction with the accompanying drawings wherein:

FIG. 1 is a perspective view of a first electrical connector member having a self-locking coupling nut mounted thereto and an adjacent second electrical connector member prior to mating;

FIG. 2 is a cross-sectional view taken along line 2—2 of FIG. 1 (connector 20 is show for clarity only);

FIG. 3 is a cross-sectional view taken along lines 3—3 of FIG. 2;

FIG. 4 is an enlarged view of the portion indicated by reference number 4 shown in FIG. 3;

FIG. 5 is a view along lines 5—5 of FIG. 4;

FIG. 6 is a cross sectional view taken along line 6—6 of FIG. 3; and FIG. 7 is a simplified sectional view taken along line 7—7 of FIG. 3 illustrating how the coupling is joined to the first electrical connector without the use of fastening members.

DETAILED DESCRIPTION OF THE INVENTION

FIG. 1 is a perspective view of a multipin and socket electrical connector assembly designated generally by the numeral 10 in the unmated condition. Assembly 10 includes a first electrical connector, or receptacle 20, and a second electrical connector, or plug 30. The mechanical connection of the receptacle 20 and plug 30 is accomplished by means of a coupling ring, or nut, 32, in a manner to be described hereinafter. The coupling ring 32, in the embodiment illustrated, is carried by the plug 30 and comprises knurled portion 33 and a cylindrical shell portion 35.

The receptacle 20 is conventional and well known in the art (alternative receptacles may be utilized) and includes a threaded receptacle shell 34, which is a generally tubular metal member of circular cross section which may include a mounting flange 36, whereby receptacle 20 may be fixably secured to an associated stationary support member by conventional fasteners. Although not shown, the receptacle 20 is adapted to include an insulating insert assembly which serves to retain and hold the plurality of electrical contacts in a customary and well known fashion. And axially extending keyway 38 is placed about the interior wall of the shell 34, facilitating proper alignment of the plug 30 relative to receptacle 20 via slot 40 formed on the plug 30 in a conventional manner.

The plug 30, conventional except for flange and groove portions formed thereon in a manner to be described, comprises a generally circular tubular metal member defining a shell 42 which has a threaded portion 44 as illustrated. A plurality of axially extending alignment members 46 are formed on the outer circumference of the threaded portion 44 as illustrated to enable the plug 30 to be joined to a second receptacle if required. In the embodiment illustrated, the coupling nut has a plurality of fastening devices 48, such as screws, formed along the knurled portion of the coupling nut 32 and as will be explained hereinafter in more detail is utilized to join the coupling nut 32 to the plug 30. It should be noted that press pins or lock pins may, for example, be utilized in lieu of screws as fastening members 48 in the conventional manner.

FIG. 2 is a cross sectional view along line 2—2 of FIG. 1, the electrical connector assembly 10 comprising the receptacle 20 and plug 30 connected together via coupling nut 32. The inner surface of the coupling nut 32 has a threaded portion 50, and as the coupling nut 32 is rotated to further engage the receptacle 20 and plug 30, coupling nut 32 is advanced over the threaded portion 34 of receptacle 20 in the conventional manner. As is shown the plug shell 42 includes a flange member 51 having an annular groove or channel 52 comprised of ridges, or lip portions, 53 formed around the circumference of the shell 42. A groove or channel 54 is formed in the wall 57 of plug 30 around its circumference below groove 52 as illustrated. Referring now to FIGS. 2–6, supported by ridges 53 of annular groove 52 is a flexible stainless steel belt member 60 which contains a plurality of spring leaf members 62 formed thereon, the belt having a plurality of openings 64 formed adjacent to the spring leaf members 62 to allow the spring leaf member 62 to be forced therethrough and into channel 54 when an appropriate force is applied to the rear portion 66 (or front portion 69) of the spring leaf member 62. A rounded slot 68, shown more clearly in FIG. 5, is formed in the flange member 51 to allow the shaped ends of the belt member 60 to overlap and be spot welded (represented by a reference numeral 70), the shaped belt end being polarized to slot thus preventing movement of belt member 60. The inner surface of coupling nut 32 has a plurality of notches 72 formed therein as illustrated. A stainless steel ring member 80, preferably split to allow for ease of manufacture and assembly, and having a plurality of bosses 82 is positioned in the annular groove 52 in a manner such that the bosses 82 align with and engage corresponding notches 72 formed in the coupling nut 32 as illustrated in FIGS. 3 and 4. The inner surface of the split ring member 80 comprises a plurality of serrations, or ratchet teeth, which as will be described more fully hereinafter, engages the spring leaf members 62 as the coupling nut is rotated in either the coupling (tightening) or decoupling (untightening) directions. As shown clearly in FIGS. 3,4 and 6, the fastening members 48 (although only four are shown, either more or less can be utilized) in the embodiment illustrated join the coupling nut 32 to the split ring member 80, the coupling nut thus in turn being joined to the plug member 30. Preferably, the relationship between projections 62 formed on the belt member 60 and notches formed between adjacent ratchet teeth is such that at least one projection member 62 is positioned in the notch at any one time as shown in FIGS. 3 and 4.

The self-locking feature of the present invention is provided in the following manner: the belt 60 is formed in a standard manner one end of the belt being formed in a circular shape to fit in the slot 68 as shown in FIG. 5. A plurality of spring leafs 62 are then formed in belt 60 with the surrounding aperture area 64. Typical belt dimensions include a length of approximately 3.96 inches and a width of 0.120 inches. The thickness of the belt is on the order of 0.010 inches. The belt 80 is comprised of Berlyco 172 alloy, available for example from the Brush Corporation, Los Angeles, Calif. or the 300 Series Spring tempered stainless steel available from Ducommun Metals & Supply Company, Los Angeles, Calif. The belt 80 is then positioned around the bottom of the annular groove 52 and supported by the circumferential edge portions, or ridges, 53 which form the groove with the belt ends positioned within the slot 68 as shown in FIG. 5, the ends thereof being spot welded. The split-ring 80 is then positioned around the belt member 60 within the annular groove 52 formed by flange 51 and thereafter the coupling nut 32 is positioned over the split-ring 80 in a manner such that the bosses 82 formed on the outer surface of the split ring 80 are within notches 72 formed on the inner surface of the coupling nut 32 (any timing device can be utilized, such as bosses or pins on one connecting part (such as the split ring) and holes formed on the other (such as the coupling nut)). Fastening members 48 are then positioned in apertures 85 formed through the thickness of the coupling nut 32 and through the bosses formed in the nut 80 such that the coupling nut 32 is physically joined to the split-ring 80. The combination of the joining of the coupling nut 32 to the split-ring 80, the interaction between the bosses 82 formed on the outer surface of the split-ring 80 within the notches 72 formed on the inner surface of the coupling nut 32 and the positioning of the split-ring member 80 and belt member 60 within the groove 52 in flange 51 is such that the coupling nut 32 is securely joined to the plug 30 in the embodiment illustrated.

In operation (after the parts have been joined as set forth hereinabove), the plug 30 is inserted into receptacle 20 in a manner such that the keyway 38 is aligned with the slot 40, the coupling nut portion 35, having a threaded portion 50 thereon is then forced over the thread 34 by rotation of the coupling nut 32 in the clockwise, or coupling, direction. As the coupling nut 32 is rotated in this direction, the inclined surfaces 84 of the ratchet teeth on split-ring 80 first engage the rear portion 66 of the spring leaf protrusion 62 in the manner to force the protrusions downwardly into the openings 64 and in such a manner that the force required to turn the coupling nut in the coupling direction does not unduly affect the coupling operation. In the decoupling or counterclockwise direction, the inclined surfaces 84 of the ratchet teeth (notches are formed between adjacent teeth) are initially incident on the free, or front, end 69 of the spring leaf protrusion 62 and the force required to push the spring leaf protrusions 62 down into the openings 64 is substantially increased over that required to force the spring leaf protrusions into the openings 64 in the clockwise or coupling direction. Typically, 32 ratchet teeth are provided on split-ring member 80 and a minimum of three spring leaf protrusions 62/openings 64 are formed on the belt. In the preferred design, at least one protrusion 62 should always be positioned in a notch area as shown in the figures. Thus an anti-rotation or decoupling feature is provided in the electrical connector assembly of the present invention and is such to make it much more difficult for decoupling due to vibrations or other disturbances.

Another feature of the present invention is that the belt member 60 may not be required in the assembly and yet the assembly still would be operable. For example, certain original equipment manufacturers may specify the fact that an anti-rotation feature (ratchet teeth engaging the spring leaf protrusions formed on belt member 60 as described hereinabove) is not required and all that is desired is to have a coupling nut which is fixed to plug 30. In this case, belt member 60 would be omitted from the assembly and the coupling nut 32 would be joined to the split-ring 80 via the fastening members 48, this in turn securely joining the coupling nut 32 to plug 30, thus preventing coupling nut 32 from slipping off plug 30.

FIG. 7 is a cross-sectional view along line 7—7 of FIG. 3 illustrting an alternate arrangement whereby the coupling nut 32 is secured to the slip-ring 80 (and thus to plug 30) without the use of fastening members 48 (since the FIG. 3 embodiment differs only from the FIG. 7 embodiment in the technique of coupling the ring member and coupling nut, for the purposes of illustration, the section along line 7—7 of FIG. 3 was taken to show the FIG. 7 embodiment). In this embodiment, the rear portion (near knurled end) of coupling nut 32 is modified to incorporate an annular lip portion 85. In essence, a conventional spining process is utilized to provide a tight groove interference fit between the body of coupling nut 32 and split-ring 80, the spining operation entrapping split-ring 80. In this case, after the proper parts are assembled (connector with or without belt 60), the modified coupling nut is positioned adjacent split-ring 80 (lip portion 85 initially in the position shown in phantom) and then rotated, localized pressure being applied to lip portion 85 to force it to the position shown in solid against the raised side edge surface 89 of split-ring 80.

The present invention thus provides a simple and economical method of providing a self-locking coupling nut for electrical connectors and also provides a means for securing the coupling nut to the underlying connector part with a minimum of parts. The present invention, in particular, allows a user to specify the type of connector desired i.e., one with either a self-locking feature or one that has both a self-locking feature and a feature for securely joining the coupling nut to the underlying connector member. The connector as tested allows this to be accomplished, the elimination of the belt member not adversely affecting the joining of the coupling nut to the underlying connector member.

In essence, the split-ring member 80 provides a dual function; it can be utilized for the self-locking feature as described hereinabove and also utilized to join the coupling nut to the underlying connector member. The duality of function thus provided reduces the number of parts necessary to provide these features (specifically in the embodiment illustrated in FIG. 7) when compared to prior art connectors which generally require a separate retaining ring to maintain the coupling nut on the connector member, or part, reducing the cost of the overall connector. Further, the dual function capability simplifies the connector manufacturing/assembly process and also allows the manufacturer of the connector assembly of the present invention to provide a choice of options to a potential user.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. An electrical connector having an outer shell and adapted to be secured to a mating electrical connector member comprising:

a flange member comprising first and second flanges, said first and second flanges extending around the circumference of said shell to form an annular groove therebetween, the bottom portion of said groove comprising first and second edge portions and a channel formed between said first and second edge portions;

a ring member having inner and outer circumferences, a plurality of ratchet teeth projecting from the inner surface of said ring member, a plurality of apertures formed through said ring member, said ring member being positioned in said annular groove;

a coupling nut adapted to engage said outer shell and said mating electrical connector member, a portion of the outer surface of said coupling nut having a plurality of apertures formed therethrough and arranged to be aligned with corresponding apertures formed in said ring member; and means passing through said aligned apertures for joining said coupling nut to said ring member whereby said coupling nut is prevented from slipping off said electrical connector.

2. The connector of claim 1 wherein said joining means pass through extensions formed on the outer circumference of said ring member.

3. The connector of claim 2 wherein said inner surface of said coupling nut has a plurality of notch like members which are adapted to receive said extensions.

4. The connector of claim 1 wherein a belt member having a plurality of resilient protrusions formed thereon is positioned in said groove beneath said ring member and supported by said first and second edge portions.

5. The connector of claim 4 wherein said resilient protrusions are adapted to engage the said ratchet teeth in a manner to allow for ease in coupling said shell to said mating member and a greater resistance to decoupling.

6. The connector of claim 1 wherein said ring member comprises a split-ring.

7. The connector of claim 5 wherein said belt member comprises openings formed around said protrusions whereby said protrusions are forced through said openings when they are engaged by said ratchet teeth.

8. The connector of claim 4 wherein said first and second flanges have slots for receiving at least one end portion of said belt member.

9. The connector of claim 5 wherein at least one protrusion is always positioned in the notch area formed between adjacent ratchet teeth.

10. The connector of claim 7 wherein said protrusions extend into said channel when an appropriate force is applied to the protrusions by said ratchet teeth.

11. An electrical connector having an outer shell and adapted to be secured to a mating electrical connector member comprising:

a flange member comprising first and second flanges, said first and second flanges extending around the circumference of said shell to form an annular groove therebetween, the bottom portion of said groove comprising first and second edge portions and a channel formed between said first and second edge portions;

a ring member having inner and outer circumferences, said ring member having a plurality of extensions formed on said outer circumference and a plurality of ratchet teeth projecting from the inner surface of said ring member, said ring member being positioned in said annular groove;

the outer circumference of said ring member extending above said first and second flanges; and a coupling nut adapted to engage said outer shell and said mating electrical connector member and having an annular lip portion which is in tight engagement with the side surface of said ring member extending above said first and second flanges whereby said coupling nut is tightly joined to said ring member in a manner whereby said coupling nut is prevented from slipping off said electrical connector.

12. The connector of claim 11 wherein the inner surface of said coupling nut has a plurality of notch like members which are adapted to receive corresponding ones of said ring member extensions.

13. The connector of claim 11 wherein a belt member having a plurality of resilient protrusions formed thereon is positioned in said groove beneath said ring member and supported by said first and second edge portions.

14. The connector of claim 13 wherein said resilient protrusions are adapted to engage the said ratchet teeth in a manner to allow for ease in coupling said shell to said mating member and a greater resistance to decoupling.

15. The connector of claim 11 wherein said ring member comprises a split-ring.

16. The connector of claim 14 wherein said belt member comprises openings formed around said protrusions whereby said protrusions are forced through said openings when they are engaged by said ratchet teeth.

17. The connector of claim 13 wherein said first and second flanges have slots for receiving at least one end portion of said belt member.

18. The connector of claim 14 wherein at least one protrusion is always positioned in the notch area formed between adjacent ratchet teeth.

19. The connector of claim 16 wherein said protrusions extend into said channel when an appropriate force is applied to the protrusions by said ratchet teeth.

20. A system wherein a first mating part has an outer shell and is adapted to be secured to a second mating part comprising:

a flange member comprising first and second flanges, and first and second flanges extending around the circumference of said shell to form an annular groove therebetween;

a ring member having inner and outer surfaces, a plurality of ratchet teeth projecting from the inner surface of said ring member, said ring member being positioned in said annular groove;

a coupling nut adapted to engage said outer shell and said second mating part;

a belt member having a plurality of resilient protrusions formed thereon positioned in said groove beneath said ring member, said resilient protrusions being adapted to engage the said ratchet teeth in a manner to allow for ease in coupling said shell to said second mating part and a greater resistance to decoupling; and means for joining said coupling nut to said ring member whereby said coupling nut is prevented from slipping off said first mating part.

21. The system of claim 20 wherein the outer surface of said ring member is shaped in a manner to join said coupling nut to said ring member.

* * * * *